US010806277B1

(12) United States Patent
Chargois

(10) Patent No.: US 10,806,277 B1
(45) Date of Patent: Oct. 20, 2020

(54) DYNAMIC NON-PIERCING TACTILE AND MANIPULABLE SUSPENSION SYSTEM

(71) Applicant: THE BANANA BUNGEE LLC, Katy, TX (US)

(72) Inventor: Trevor A. Chargois, Katy, TX (US)

(73) Assignee: THE BANANA BUNGEE LLC, Katy, TX (US)

( * ) Notice: Subject to any disclaimer, the term of this patent is extended or adjusted under 35 U.S.C. 154(b) by 231 days.

(21) Appl. No.: 15/370,489

(22) Filed: Dec. 6, 2016

Related U.S. Application Data

(60) Provisional application No. 62/268,437, filed on Dec. 16, 2015.

(51) Int. Cl.
*A47F 7/00* (2006.01)
*A47F 5/00* (2006.01)

(52) U.S. Cl.
CPC ..... *A47F 7/0078* (2013.01); *A47F 5/0006* (2013.01)

(58) Field of Classification Search
CPC ..... A47F 7/0078; A47F 5/0006; A45F 2005/006; A45F 2005/1013
See application file for complete search history.

(56) References Cited

U.S. PATENT DOCUMENTS 285,159 A * 9/1883 Reynolds ..... A01F 5/12 211/125
725,458 A 4/1903 Levy
903,067 A 11/1908 Engman
911,508 A 2/1909 Look
934,808 A 9/1909 Hiss
1,211,926 A 1/1917 Dodd
1,505,539 A * 8/1924 Burke ..... A47F 7/0071 248/127
1,740,520 A * 12/1929 Murphy ..... A47F 5/0006 211/115
1,795,779 A * 3/1931 Kennedy ..... G01G 3/02 177/156
1,972,505 A * 9/1934 Wilson ..... A47F 5/0006 211/106
2,038,903 A * 4/1936 Rakatzky ..... A47F 7/0071 211/169
2,245,126 A * 6/1941 Day ..... A47F 5/0006 24/698.1
2,362,137 A * 11/1944 Kagan ..... A47F 5/0006 24/371
2,432,957 A * 12/1947 Webster ..... D06F 57/00 211/113
2,764,305 A 9/1956 Reich
(Continued)

FOREIGN PATENT DOCUMENTS

DE 3037842 A1 * 5/1982 ..... A47F 5/0006
DE 3934013 C1 * 4/1991 ..... A47F 5/0006
(Continued)

*Primary Examiner* — Stanton L Krycinski

(57) ABSTRACT

Disclosed is a dynamic non-piercing tactile and manipulable suspension system for suspending target items such as fruit including but not limited to bananas both in hands and individually. An integration housing comprises one or more suspension strands coupled to the integration housing on one end and one or more suspension contacts on the other end, the suspension strand and coupled suspension contact being capable of suspending (without piercing) a hand of bananas and/or a single banana.

23 Claims, 10 Drawing Sheets

(56) References Cited

U.S. PATENT DOCUMENTS 3,096,010 A * 7/1963 Rasmussen ..... A01M 31/00 224/250
3,188,130 A * 6/1965 Pietrowicz ..... A22B 5/06 224/921
3,484,070 A * 12/1969 Zukowska ..... A47F 5/08 24/298
3,709,373 A * 1/1973 Aguilar ..... A47F 5/0892 211/113
3,999,821 A * 12/1976 Moody ..... A47F 5/0006 312/236
4,141,529 A * 2/1979 Casutt ..... G09F 3/04 248/686
4,242,813 A * 1/1981 Quance ..... A63C 11/023 12/120.5
D278,456 S * 4/1985 Lewis ..... 224/103
4,523,357 A 6/1985 Widditsch
4,678,221 A * 7/1987 Josenhans ..... A45F 5/10 206/150
5,020,192 A * 6/1991 Gerlach ..... F16G 11/12 24/115 R
5,148,926 A * 9/1992 Cocuzzo ..... A47K 3/281 211/118
5,285,908 A * 2/1994 Rogers ..... A47F 5/0006 211/117
5,351,346 A * 10/1994 Hodges, Jr. ..... A47K 3/281 211/113
5,364,053 A 11/1994 Rodgers
D354,429 S 1/1995 McNaughton
D361,472 S 8/1995 Heilicher
D367,153 S * 2/1996 Sturm ..... D6/674
D369,482 S * 5/1996 McArdle ..... D7/601
5,743,451 A * 4/1998 Kahn ..... A45F 5/021 224/268
5,771,790 A * 6/1998 Barrows ..... A23B 7/144 211/113
5,826,843 A * 10/1998 Sturm ..... A47F 7/0071 248/176.1
5,853,213 A * 12/1998 Simpson ..... A45F 5/10 294/158
5,873,616 A * 2/1999 Kirschbaum ..... A45F 5/10 294/150
5,901,999 A * 5/1999 Brock ..... A01M 31/00 294/137
6,003,210 A * 12/1999 Facey ..... F16G 11/14 24/130
6,062,449 A * 5/2000 Kahn ..... A45F 5/02 224/268
6,076,685 A * 6/2000 Ramirez ..... A47F 5/0006 211/113
D430,791 S 9/2000 Hook et al.
6,145,170 A 11/2000 Bernard et al.
6,161,703 A * 12/2000 Mihok ..... A47G 25/10 211/31
6,164,616 A 12/2000 Woods et al.
6,330,949 B1 * 12/2001 DeRisio ..... A47F 5/0006 211/113
6,416,026 B1 * 7/2002 Porraro ..... A47F 7/0078 248/309.1
6,425,167 B1 * 7/2002 Barbarite ..... A47G 25/00 24/298
6,443,342 B1 * 9/2002 Kahn ..... A45F 5/02 224/268
6,454,335 B1 * 9/2002 Wishnick ..... A63C 11/023 280/816
6,604,320 B1 8/2003 Hsia
6,682,032 B1 * 1/2004 Bradlee ..... A47F 5/0006 248/215
6,854,609 B1 2/2005 Hettinger
6,880,794 B1 * 4/2005 Kahn ..... A45F 5/02 24/115 R
6,886,796 B1 * 5/2005 Elander ..... A47F 5/0006 211/70.6
7,000,809 B1 * 2/2006 Stroud ..... A45F 5/02 224/250
7,152,367 B2 12/2006 Mastronardi
7,311,289 B2 * 12/2007 Mori ..... A47B 21/045 248/165
D586,624 S 2/2009 Goodman et al.
7,563,047 B2 * 7/2009 Paluda ..... B43K 23/001 401/131
7,757,996 B2 7/2010 Jacobs
D624,393 S 9/2010 Frey
7,798,056 B2 9/2010 Kramer
D637,403 S 5/2011 Schmidt
8,191,849 B1 6/2012 Lembke
8,783,628 B2 7/2014 Jette
9,441,785 B2 * 9/2016 Sterling ..... F16M 13/022
2004/0124323 A1 * 7/2004 Kamenstein ..... A47F 5/0006 248/121
2005/0173477 A1 * 8/2005 Scott ..... A45F 5/02 224/148.6
2005/0236854 A1 * 10/2005 Lonadier ..... A45F 5/10 294/153
2008/0264884 A1 10/2008 Felder
2013/0185900 A1 * 7/2013 Campbell ..... F16G 11/101 24/301
2013/0232732 A1 9/2013 Jacobson et al.
2015/0296979 A1 * 10/2015 Todd ..... A47B 75/00 211/85.4
2015/0327674 A1 11/2015 Stevens
2016/0213169 A1 * 7/2016 Kennedy ..... A47F 5/0006
2017/0127827 A1 * 5/2017 Lehman ..... A47B 43/00

FOREIGN PATENT DOCUMENTS

DE 9411877 U1 * 9/1994 ..... A47F 5/0006
FR 2886530 A1 * 12/2006 ..... A47F 5/0006
GB 1168148 A * 10/1969 ..... G09F 3/04
JP 2006296222 A * 11/2006

* cited by examiner 110
126
122'
128
124
100
122
144
164
400'
300'
148
142
168
162
400
300
302
402
304
306
404
166
146
406

FIG. 6A
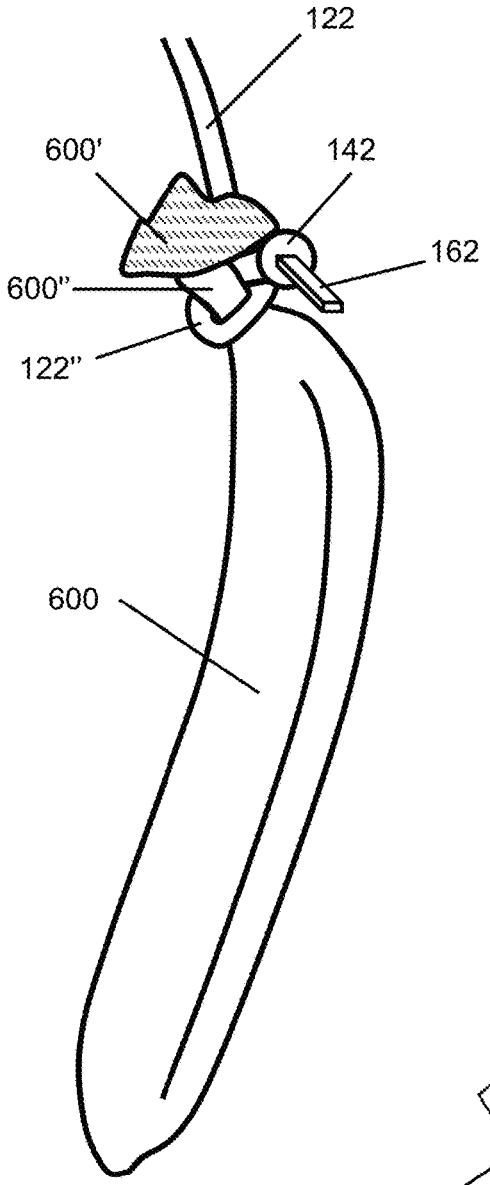
FIG. 6B
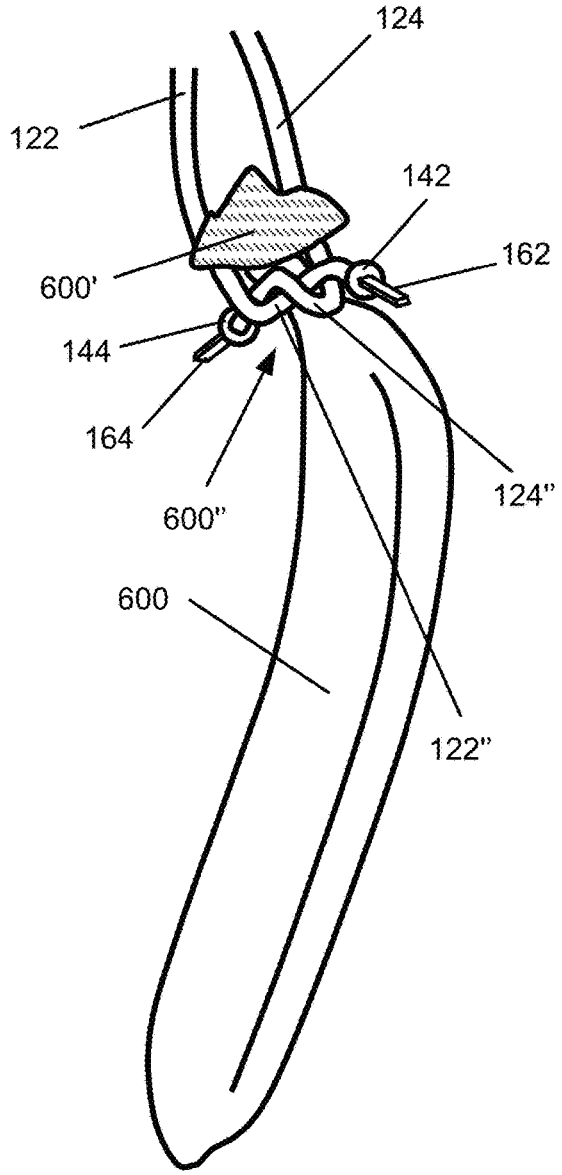
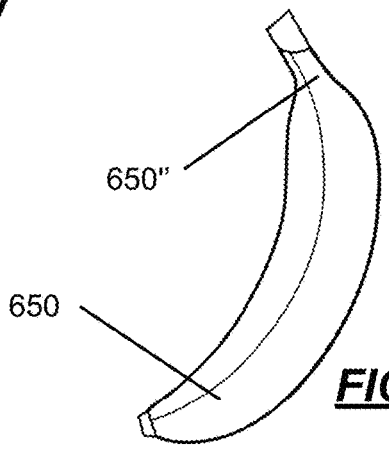
FIG. 6C 122a
122b
822
100b
810
802
162
142

122x
100c
820
142
162
804

122y
100d
142
162'
806
650''
650
(Copy of FIG. 6C)

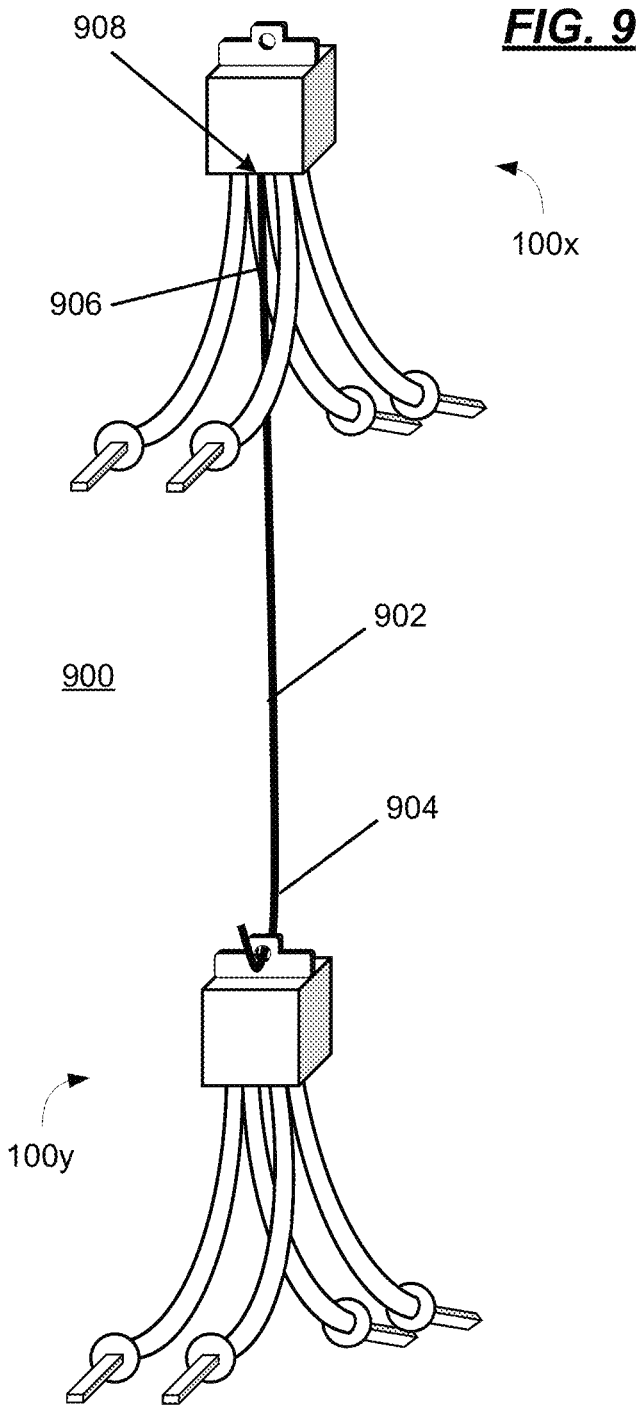
FIG. 9
FIG. 10
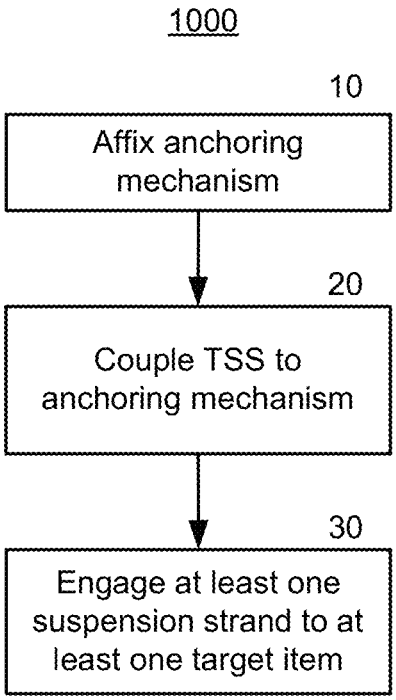

DYNAMIC NON-PIERCING TACTILE AND MANIPULABLE SUSPENSION SYSTEM

CROSS-REFERENCE TO RELATED APPLICATIONS

This application claims benefit of and priority to, and incorporates herein by reference in its entirety, U.S. Provisional Application No. 62/268,437, filed Dec. 16, 2015, titled "AN APPARATUS FOR SUSPENDING A HAND OF BANANAS".

BACKGROUND

Domesticated bananas (or "plantains") are edible fruits that have an easily recognizable elongated and curved form with a soft inner flesh that is rich in starch and covered with a rind (or "peel"). Banana fruit grows in clusters typically hanging from upper regions of the banana plant. The banana fruits develop from female flowers into large hanging clusters made up of tiers of "hands" of fruit. A cluster generally comprises up to twenty fruit per tier. The hanging cluster is known as a "bunch," and a bunch generally comprises three to twenty hands. An individual banana fruit is commonly referred to simply as a "banana" or a "finger." As used herein, the term "hand" may also be used to refer to any subset of bananas from a tier attached to each other at the stems (as opposed to individual bananas that are not attached to each other at the stem, each of which is still a "finger" but collectively, without being attached to each other at the stem, do not constitute a "hand").

Storing bananas is a challenge for a variety of different reasons. For example, bananas bruise easily when they come into contact with external surfaces, and thus storing bananas on a kitchen counter or other similar surface causes bruising on the bananas where contact is made with such surfaces. For this reason many solutions to banana storage employ some sort of suspension system where a hand of bananas is suspended in a manner intended to minimize (if not completely avoid) contact with external surfaces.

Typical banana suspension systems often utilize a smooth metal hook that either (a) slips between the fingers in a hand and engages the stem structure to which all fingers in the hand are interconnected or (b) pierces the stem structure (or one of the bananas) to maintain contact between the hook and the bunch. However, hook-based approaches have several shortcomings, chief among them being the inability to suspend a single banana without piercing some part of the banana or stem structure (which requires a sharp-tipped hook). Hook-based structures also generally are unable to support more than one hand of bananas at a time. Certain hook-based structures—especially those with a sharp tip for piercing bananas—can also pose a safety hazard to the fingers and hands of human handlers, may snag clothing, and may become breeding grounds for bacteria and other microbes growing in residue remaining on the hook after piercing any part of a banana hand.

Although there are some existing suspension systems that do not utilize a hook, many of these systems still suffer shortcomings in, among other issues, the limited number of hands that typically can be suspended, the inability to distribute weight among more than one suspension point for a single hand, and/or the inability to suspend a single banana particularly where that single banana lacks a complex stem (which may also be referred to as a "complex stem end" herein). As such, there is a need for a dynamic non-piercing suspension system for bananas, other fruit, and other "target items" that are not adequately served by existing suspension solutions available today.

SUMMARY

Disclosed herein are various implementations (to include example constructions or embodiments). These include implementations directed to a dynamic non-piercing tactile and manipulable suspension system for suspending target items such as fruit, including but not limited to bananas, both in hands and individually.

More specifically, various implementations disclosed herein may comprise: an integration housing comprising at least one anchor engagement for use in suspending the anchor housing; one or more suspension strands, each suspension strand comprising a first end and a second end opposite the first end, the first end of each suspension strand coupled to the integration housing; and one or more suspension contacts, each suspension contact coupled to the second end of a suspension strand from among the one or more suspension strands, the suspension strand and coupled suspension contact being capable of: suspending a hand of bananas in a first use without piercing the hand of bananas, and suspending a single banana in a second use without piercing the single banana.

Several such implementations may further feature one or more of the following: wherein the single banana (for suspension) comprises a simple stem but lacks a complex stem; wherein each suspension strand with coupled suspension contact is capable of simultaneously suspending a hand of bananas; wherein the suspended hand of bananas comprises at least three fingers and wherein at least one finger from among the at least three fingers is capable of being removed from the hand of bananas without repositioning at least one suspension strand and corresponding suspension contacts which remain capable of suspending the hand of bananas after said removal; wherein a hand of bananas is suspended by at least two suspension strands with coupled suspension contacts, and/or wherein at least two suspension strands bear a portion of a total suspension weight corresponding to the hand of bananas; wherein each suspension strand comprises a soft surface; wherein at least one suspension strand is knotable (capable of being manipulated into a knot-like form); wherein at least one suspension strand from among the one or more suspension strands comprises two substrands capable of suspending a single banana that comprises a complex stem; wherein each of the one or more suspension strands comprises flexible or elastic, or flexible and elastic, material or materials, and/or wherein at least one suspension strand from among the one or more suspension strands comprises an opening for suspending a single banana having a simple stem but lacking a complex stem; and/or wherein each of the one or more suspension contacts comprises a contact surface lacking points and lacking edges.

Several of these implementations may further (or instead) feature one or more of the following: wherein the anchor engagement comprises an engagement feature for operably coupling to an anchoring mechanism in order to suspend the apparatus comprising the engagement housing and the one or more suspension strands, wherein the suspended apparatus is capable of suspending at least one target item, and/or wherein the anchoring mechanism comprises one from among the group comprising an under-edge mounting mechanism, a shelf mounting mechanism, an eye screw, an eye bolt, a wire rod, an S-mount, and a fixed hook, and/or wherein the anchor engagement is integrated-by-manufacture into a first portion of the integration housing such that the anchor engagement is physically inseparable from, or in one piece with, the first portion of the integration housing.

Certain implementations may also comprise one or more pairs of suspension strands, each pair of suspension strands being formed from a single material strand, each single material strand comprising: an intervening portion that passes in and is retained within the integration housing; a first portion commencing from a first endpoint of the intervening portion, the first portion extending downward from and outside of the integration housing to form a first strand of the pair of strands; and a second portion commencing from a second endpoint of the intervening portion opposite the first endpoint, the second portion extending downward from and outside of the integration housing to form a second strand of the pair of strands. Some such implementations may further feature wherein the intervening portion is immovably fixed within the integration housing.

Select implementations may also comprise one or more extension tabs, each extension tab coupled to a suspension contact from among the one or more suspension contacts variously coupled to the one or more suspension strands, each extension tab coupled opposite a second end of a corresponding suspension strand coupled to the suspension contact. A subset of these select implementations may further feature: wherein the one or more extension tabs comprise flexible or elastic, or flexible and elastic, material or materials; wherein each of the one or more extension tabs is thinner than the corresponding suspension contact to which each of said extension tabs is coupled; and/or wherein at least one extension tab from among the one or more extension tabs comprises an opening for suspending a single banana having a simple stem but lacking a complex stem.

Various additional implementations disclosed herein may comprise: means for enabling said apparatus to be suspended from a suspension anchor point; and means for suspending a hand of bananas without piercing the hand of bananas, said means also capable of: suspending a single banana in a second use without piercing the single banana, engaging said hand of bananas at more than one engagement point, and engaging more than one hand of bananas simultaneously without piercing any of the more than one hand of bananas. For some such implementations, (1) the anchoring mechanism may comprise one from among the group comprising an under-edge mounting mechanism, a shelf mounting mechanism, an eye screw, an eye bolt, a wire rod, an S-mount, and a fixed hook; and/or (2) the anchor engagement may be integrated-by-manufacture into a first portion of the integration housing such that the anchor engagement is physically inseparable from, or in one piece with, the first portion of the integration housing.

In addition, various implementations disclosed herein are also directed to a method for suspending one or more bananas, the method comprising: for a hand of bananas, fitting at least one suspension strand, extending downward from a suspension point and terminating at a suspension contact, between a pair of adjacent fingers of a hand of bananas in sufficient proximity to a complex stem of the hand of bananas to prevent the suspension contact from slipping between the pair of adjacent fingers; and, for a single banana, manipulating at least one suspension strand in a stem-engaging configuration sufficient to engage the single banana proximate to the simple stem. For certain such implementations, the hand of bananas may be suspended using at least a first suspension strand while simultaneously the single banana is suspended using at least a second suspension strand that is not being utilized to suspend the hand of bananas. Select implementations may also include suspending the hand of bananas using at least two suspension strands each comprising flexible or elastic, or flexible and elastic, material or materials such that at least two suspension strands bear a portion of a total suspension weight corresponding to the hand of bananas.

This summary is provided to introduce a selection of concepts in a simplified form that are further described below in the detailed description. This summary is not intended to identify key features or essential features of the claimed subject matter, nor is it intended to be used to limit the scope of the claimed subject matter.

BRIEF DESCRIPTION OF THE DRAWINGS

The foregoing summary and the following detailed description of illustrative implementations are better understood when read in conjunction with the appended drawings. For the purpose of illustrating the implementations, there is shown in the drawings example constructions of the implementations; however, the implementations are not limited to the specific methods and instrumentalities disclosed. In the drawings:

FIG. 6A is a three-dimensional perspective view illustrating a single suspension strand of the exemplary dynamic non-piercing TSS of FIG. 1 being utilized to suspend a single banana in a manner representative of various implementations disclosed herein;

FIG. 6B is a three-dimensional perspective view illustrating a pair of suspension strands of the exemplary dynamic non-piercing TSS of FIG. 1 being utilized to suspend a single banana in a manner representative of various implementations disclosed herein;

FIG. 6C is a three-dimensional perspective view of a single banana that may also be suspended from the single suspension strand illustrated in FIG. 6A as well as from the pair of suspension strands illustrated in FIG. 6B, both in a manner representative of various implementations disclosed herein;

FIG. 9 is a three-dimensional perspective view of a first exemplary dynamic non-piercing TSS operably coupled to a second exemplary dynamic non-piercing TSS representative of certain implementations disclosed herein;

FIG. 10 is a process flow diagram illustrating an exemplary method for utilization of a TSS and an anchoring mechanism to suspend a target item representative of various implementations disclosed herein.

DETAILED DESCRIPTION

Disclosed herein are various implementations of a dynamic non-piercing tactile and manipulable suspension system that, among many other uses, is ideal for storing bananas. Various concepts helpful to more fully understand and appreciate these various implementations are herein described in support of the disclosures specifically pertaining to these various implementations that follow.

In summary, a dynamic non-piercing tactile and manipulable suspension system comprises an integration housing comprising at least one anchor engagement for use in suspending the anchor housing; one or more suspension strands, each suspension strand comprising a first end and a second end opposite the first end, the first end of each suspension strand coupled to the integration housing; and one or more suspension contacts, each suspension contact coupled to the second end of a suspension strand from among the one or more suspension strands, the suspension strand and coupled suspension contact being capable of: suspending a hand of bananas in a first use without piercing the hand of bananas, and suspending a single banana in a second use without piercing the single banana.

Figure 1:
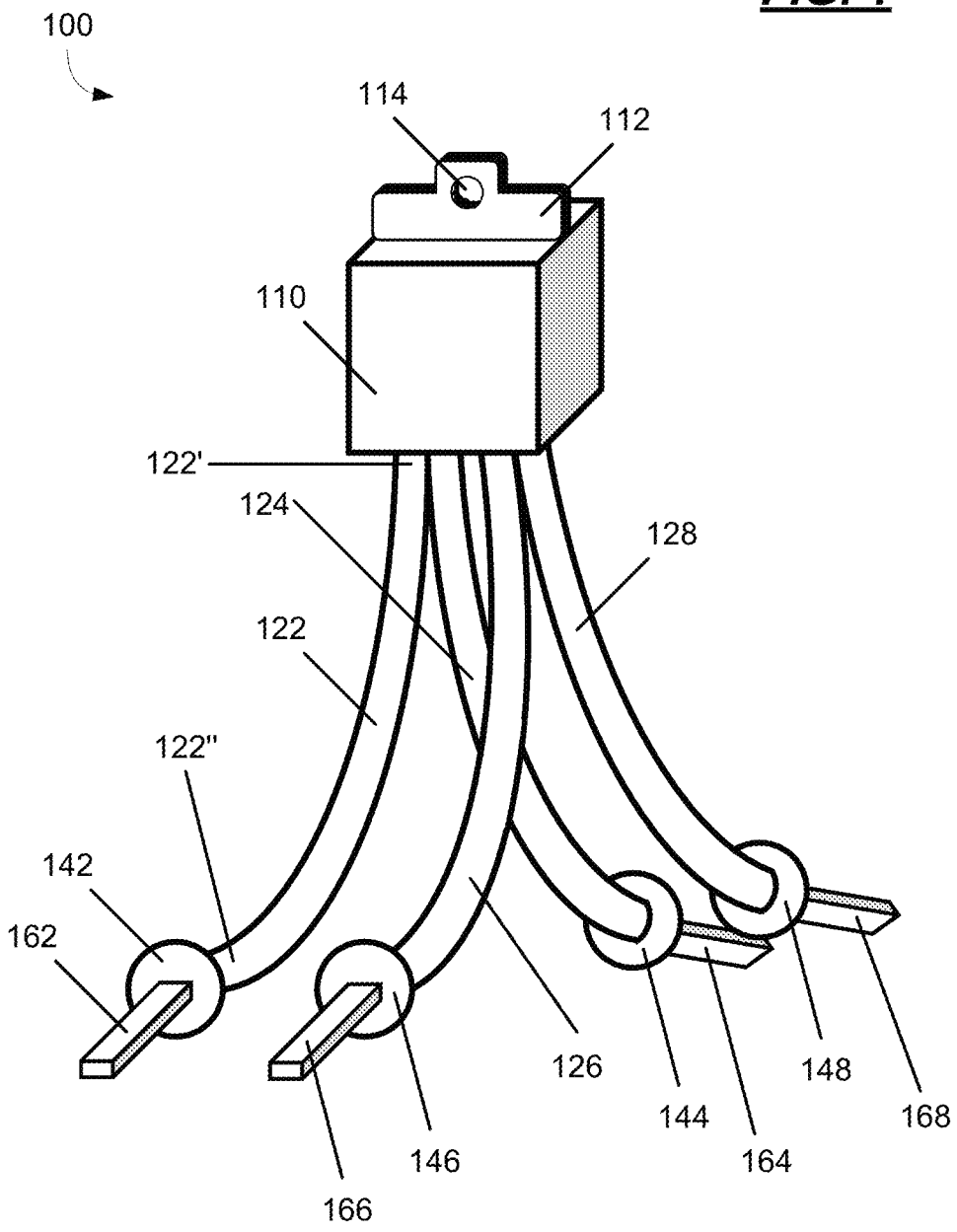
FIG. 1 is a three-dimensional perspective view of an exemplary dynamic non-piercing tactile and manipulable suspension system (TSS) comprising four suspension strands representative of various implementations disclosed herein.

FIG. 1 is a three-dimensional perspective view of an exemplary dynamic non-piercing tactile and manipulable suspension system (TSS) 100 representative of various implementations disclosed herein. In the figure, the TSS 100 comprises an integration housing 110, an anchor engagement 112 coupled to the upper side of an integration housing 110, and one or more suspension strands 122, 124, 126, 128 coupled to the lower side of the integration housing 110. The anchor engagement 112 may feature an engagement feature 114 for operably coupling to any of various anchor points. The one or more suspension strands 122, 124, 126, 128 extend generally downward from integration housing 110. For several implementations, an upper end (e.g., 122') of each suspension strand 122, 124, 126, 128 is the portion that is affixedly coupled to the integration housing 110 while a lower end (e.g., 122") of each suspension strand is affixedly coupled to a suspension contact 142, 144, 146, 148.

The suspension contacts 142, 144, 146, 148, in turn, may be each affixedly coupled to an extension tab 162, 164, 166, 168. For several such implementations, these extension tabs (a) may be coupled to a suspension contact opposite a second end of a corresponding suspension strand coupled to such suspension contact, (b) may comprise flexible or elastic, or flexible and elastic, material or materials, and/or (c) may be thinner than the corresponding suspension contact to which said extension tab is coupled to allow for easy insertion between adjacent fingers in a hand. Likewise, for various implementations each of the suspension strands may comprise flexible or elastic, or flexible and elastic, material or materials, and/or each of the suspension contacts may comprise a contact surface lacking points (e.g., corners) and lacking edges which are more likely to damage and bruise bananas. Similarly, each of the extension tabs may comprise a contact surface lacking points (e.g., corners) and lacking edges (not shown). Additionally, (1) the suspension strands 122, 124, 126, 128 and suspension contacts 142, 144, 146, 148 may exhibit, to varying degrees, a "tactile" characteristic in the sense of providing at least a de minimis friction (or "grip") when in contact with any part of a target item such as a banana, and/or (2) the suspension strands 122, 124, 126, 128 may exhibit, to varying degrees, a "manipulable" characteristic in the sense of being twisting, stretchable, shapeable, and knotable, these features being anticipated by any of the various implementations disclosed herein.

Several implementations may utilize pairs of suspension strands, each pair of suspension strands may be formed from a single material strand having an intervening portion that passes in and is retained within the integration housing, a first portion commencing from a first endpoint of the intervening portion, the first portion extending downward from and outside of the integration housing to form a first strand of the pair of strands, and a second portion commencing from a second endpoint of the intervening portion opposite the first endpoint, the second portion extending downward from and outside of the integration housing to form a second strand of the pair of strands. For certain implementations, the intervening portion is immovably fixed within the integration housing.

Regarding the anchor engagement 112, several implementations may feature: operably coupling the engagement feature to an anchoring mechanism in order to suspend the apparatus comprising the engagement housing and the one or more suspension strands, wherein the suspended apparatus is capable of suspending at least one target item. Select implementations may utilize an anchor engagement that is integrated-by-manufacture into a first portion of the integration housing such that the anchor engagement is physically inseparable from, or in one piece with, the first portion of the integration housing.

The anchoring mechanism may take several different forms, such as an under-edge mounting mechanism, a shelf mounting mechanism, an eye screw, an eye bolt, a wire rod, an S-mount, and a fixed hook, among other options and configurations.

Figure 2:
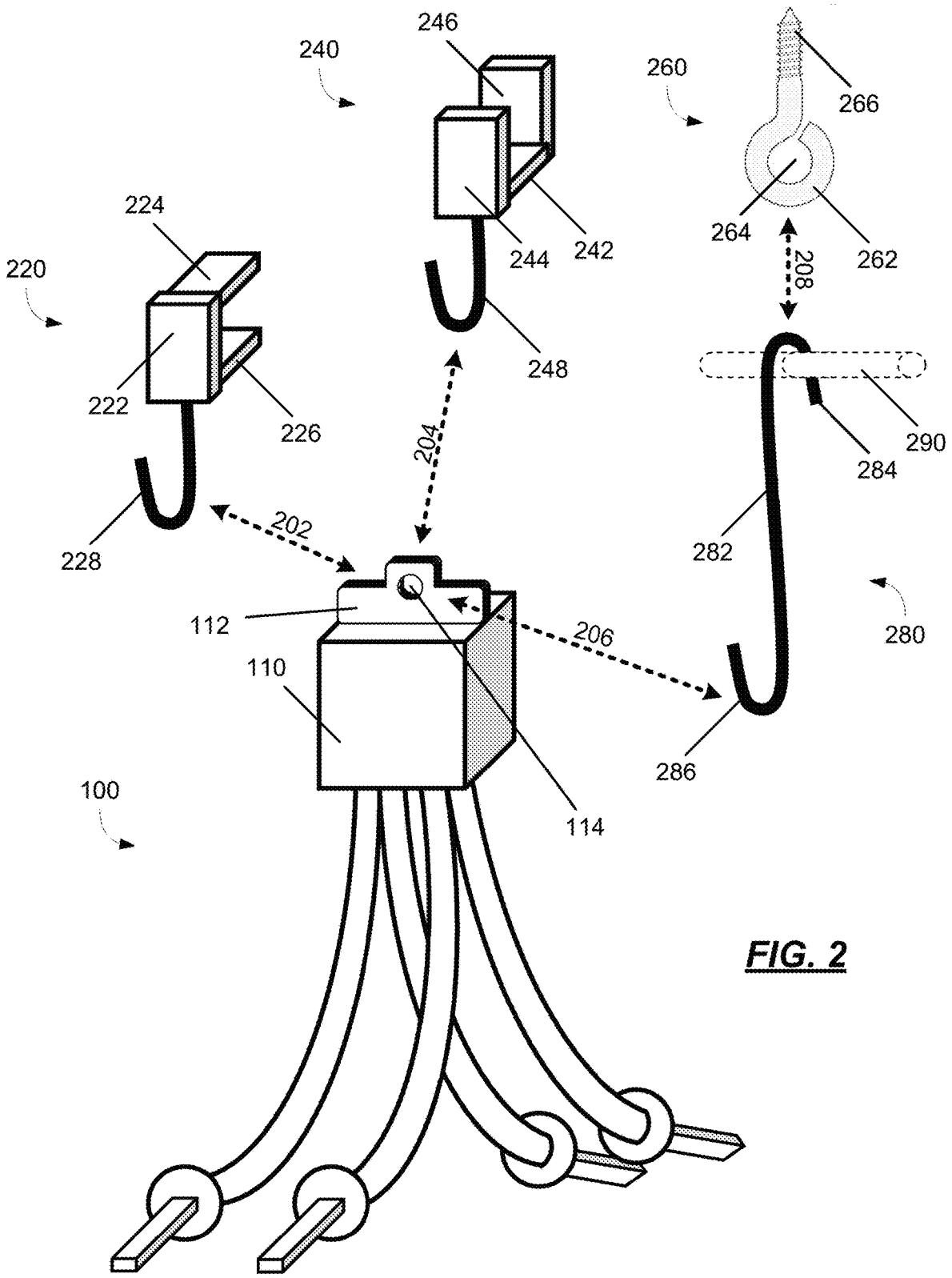
FIG. 2. is a three-dimensional perspective view of the exemplary dynamic non-piercing TSS of FIG. 1 further illustrating various anchoring mechanisms representative of various implementations disclosed herein.

FIG. 2. is a three-dimensional perspective view of the exemplary dynamic non-piercing TSS 100 of FIG. 1 further illustrating various anchoring mechanisms 220, 240, 260, 280 representative of various implementations disclosed herein. In FIG. 2, anchoring mechanism 220 comprises a vertical base 222 coupled to two spaced engagement surfaces 224 and 226 which can mount on a flat surface or an object with opposing horizontal surfaces such as the edge of a shelf and remains in position by any of several means including pinch pressure (akin to a common binder clip), adhesive, or utilization of one or more screws or screw-like devices (not shown). Anchoring mechanism 240 is similar to anchoring mechanism 220 but whereas anchoring mechanism 220 is designed to mount to opposing parallel horizontal surfaces (such as the edge of a shelf), anchoring mechanism 240 is designed to mount to opposing parallel vertical surfaces (such as the underside of a kitchen cabinet face). As such, anchoring mechanism 240 comprises a horizontal base 242 coupled to two spaced engagement surfaces 244 and 246. For both anchoring mechanism 220 and anchoring mechanism 240, a curved mount 228, 248 is provided to movably couple 202, 204 to the engagement feature 114 of the anchor engagement 112 of the integration housing 110 (said movable coupling 202, 204 being illustrated as a dashed arrows respectively there between).

Also shown in FIG. 2 is an S-mount 280 comprising an midsection 282 terminating in an upper curved mount 284 to movably couple to a bar-like surface 290—such as grill shelving in a refrigerator, for example, or other similarly engageable feature such as the eye screw of anchoring mechanism 260—and a lower curved mount 286 to movably couple 206 to the engagement feature 114 of the anchor engagement 112 of the integration housing 110 (said movable coupling 206 being illustrated as a dashed arrow there between). With particular regard to the eye screw of anchoring mechanism 260, it comprises a threaded screw component 266 affixed to eyelet 262 and provides an engageable feature 264 through which the upper curved mount 284 can be movably coupled 208 (illustrated as a dashed arrow there between).

Additionally, for certain implementations, the anchor engagement 112 of the integration housing 110 may be movably coupled 208 to any other curved mounting feature (similar to curved mounts 228, 248, 286), any other hook-like structure, a screw or nail (e.g., laterally installed into a vertical surface or hangingly installed into an angled or horizontal surface), any other type of mount or fastener, or any device that provides any of the foregoing mounts or fasteners. For example, the anchor engagement 112 of the integration housing 110 may be movably coupled 202, 204, 206, 208 to the hook-like protuberance featured by many contemporary suspension systems including but not limited to those described in U.S. Pat. Nos. 8,191,849, 6,682,032, 6,416,026, 2,362,137, and 2,245,126, as well as U.S. Design Patent No. 637,043 and U.S. Pat. No. 8,191,849. A person of ordinary skill in the relevant art will readily appreciate several obvious variations and alternatives for coupling 208 with the anchor engagement 112 of the various implementations disclosed herein, all of which are anticipated.

Figure 3:
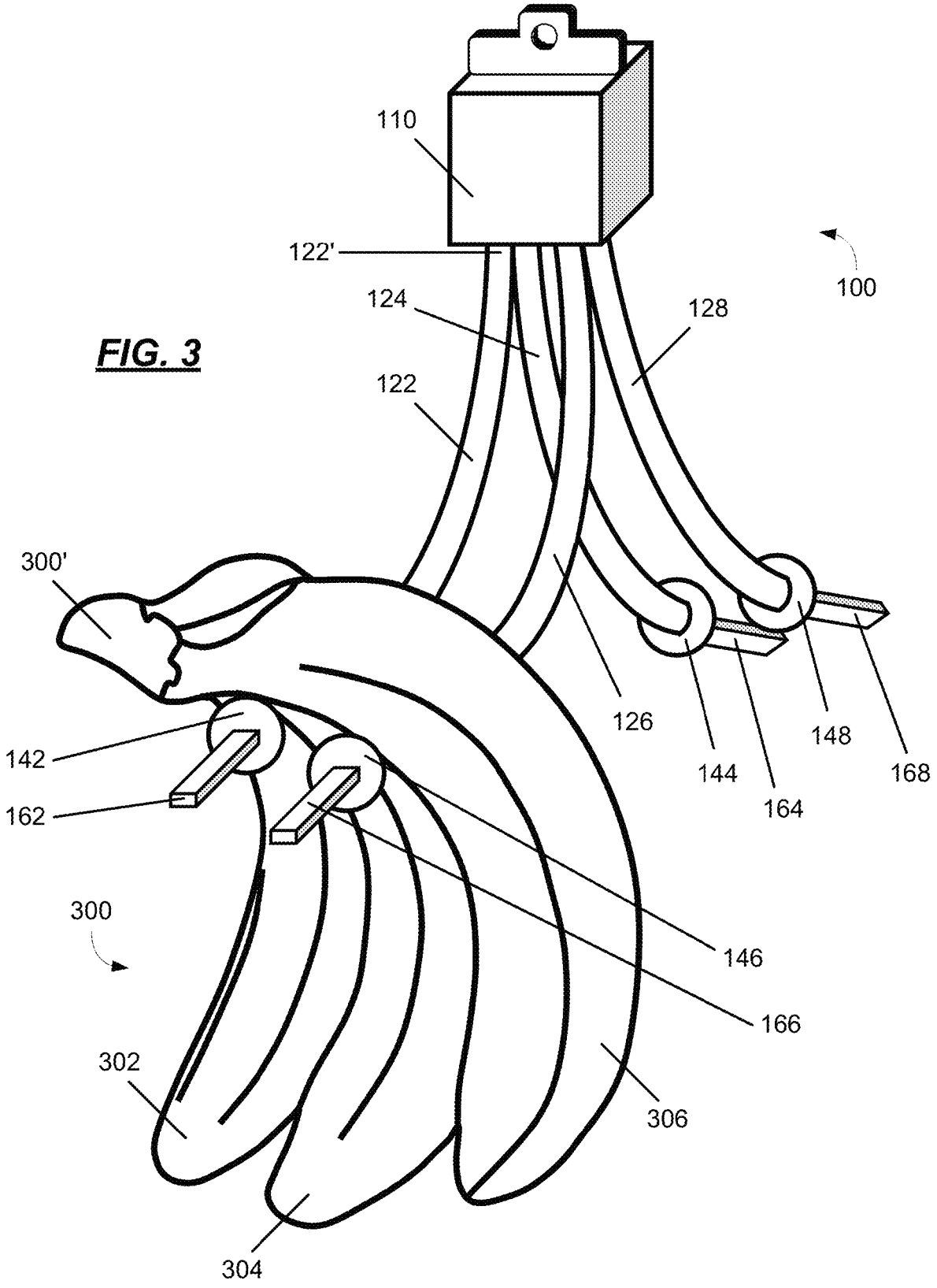
FIG. 3 is a three-dimensional perspective view of the exemplary dynamic non-piercing TSS of FIG. 1 further illustrating a single hand of bananas suspended from two suspension strands representative of various implementations disclosed herein.

FIG. 3 is a three-dimensional perspective view of the exemplary dynamic non-piercing TSS 100 of FIG. 1 further illustrating a single hand of bananas 300 suspended from two suspension strands 122, 126 representative of various implementations disclosed herein. As illustrated in the Figure, a first suspension strand 122 is positioned between a first finger 302 and a second finger 304 of the hand 300 proximate to the complex stem 300', while a second suspension strand 126 is positioned between the second finger 304 and a third finger 306 of the hand 300, also proximate to the complex stem 300'. In this fashion, where a hand of bananas 300 is suspended by at least two suspension strands 122, 126 each with coupled suspension contacts 142, 146, the two suspension strands 122, 126 each bear a portion of a total suspension weight corresponding to the hand of bananas, thereby distributing the pressure each suspension contact 142, 146 exerts on the individual fingers 302, 304, 306 and, as a result, minimizing bruising. Bruising is further mitigated when each suspension strand 122, 126 and/or each suspension contact 142, 146 features a soft surface (cloth and the like, typical of flexible materials) versus a hard surface (such as metal, typical of a hook). Notably, when the suspended hand of bananas comprises at least three fingers, at least one finger can be removed from the hand without repositioning at least one suspension strand (and corresponding suspension contact) which remains capable of suspending the hand of bananas after said removal.

Figure 4:
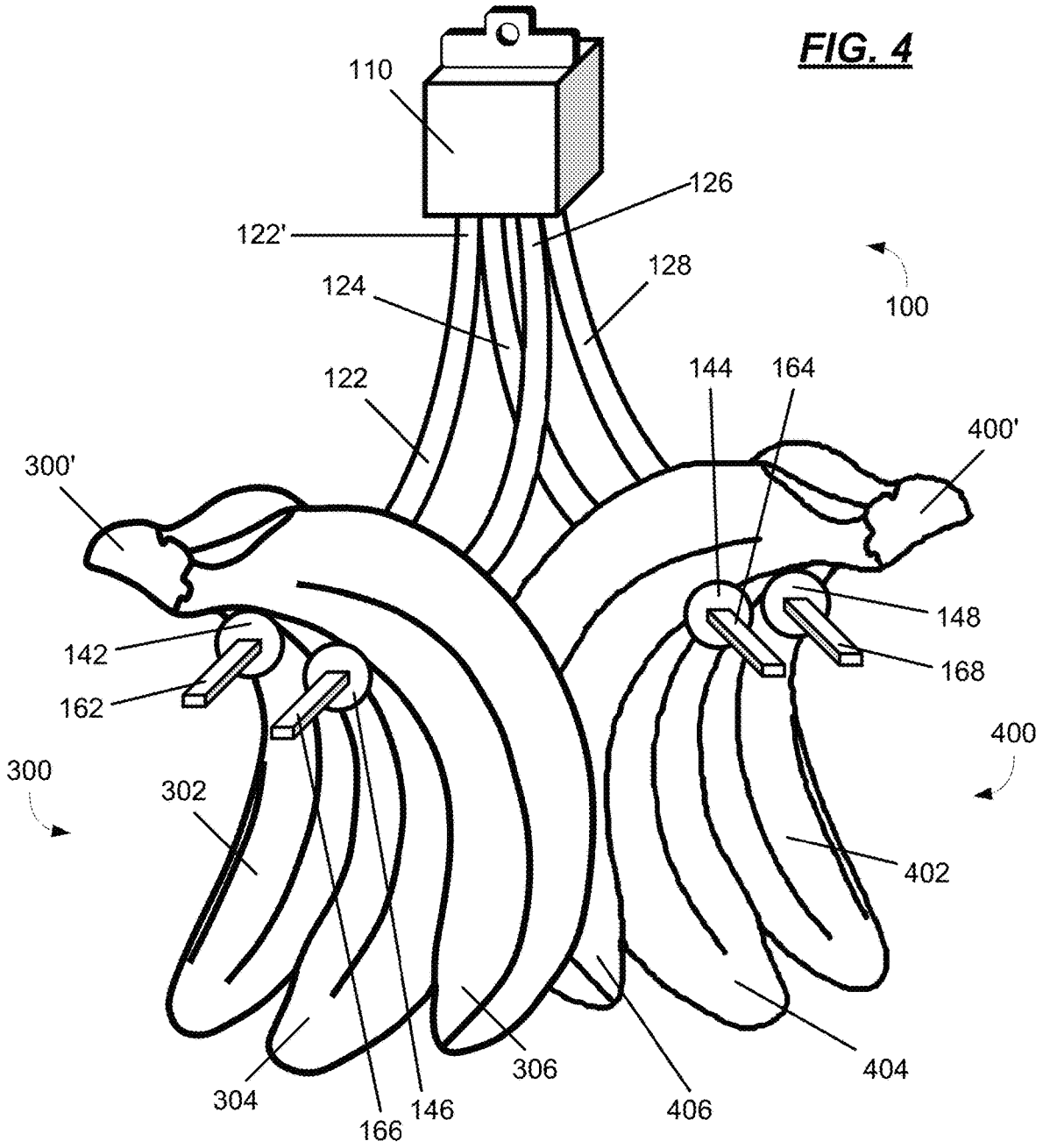
FIG. 4. is a three-dimensional perspective view of the exemplary dynamic non-piercing TSS of FIG. 1 further illustrating two hands of bananas suspended from four suspension strands representative of various implementations disclosed herein.

FIG. 4 is a three-dimensional perspective view of the exemplary dynamic non-piercing TSS 100 of FIG. 1 further illustrating two hands of bananas 300, 400 suspended from four suspension strands 122, 124, 126, and 128 representative of various implementations disclosed herein. Notably, each hand 300, 400 is suspended by at least two suspension strands 122, 124, 126, 128 each with coupled suspension contacts 142, 144, 146, 148, and all four suspension strands 122, 124, 126, 128 each bear a portion of a total suspension weight corresponding to their respective hand of bananas 300, 400 thereby distributing the pressure each suspension contact 142, 144, 146, 148 located proximal to the respective complex stems 300' and 400' exerts on the individual fingers 302, 304, 306, 402, 404, 406. Also notable is that each suspension strand 122, 124, 126, 128 with coupled suspension contact 142, 144, 146, 148 is each capable of simultaneously suspending a hand of bananas (for a total of four hands being suspended (not shown)) albeit without the benefits of distributing weight among more than one suspension strand.

Figure 5:
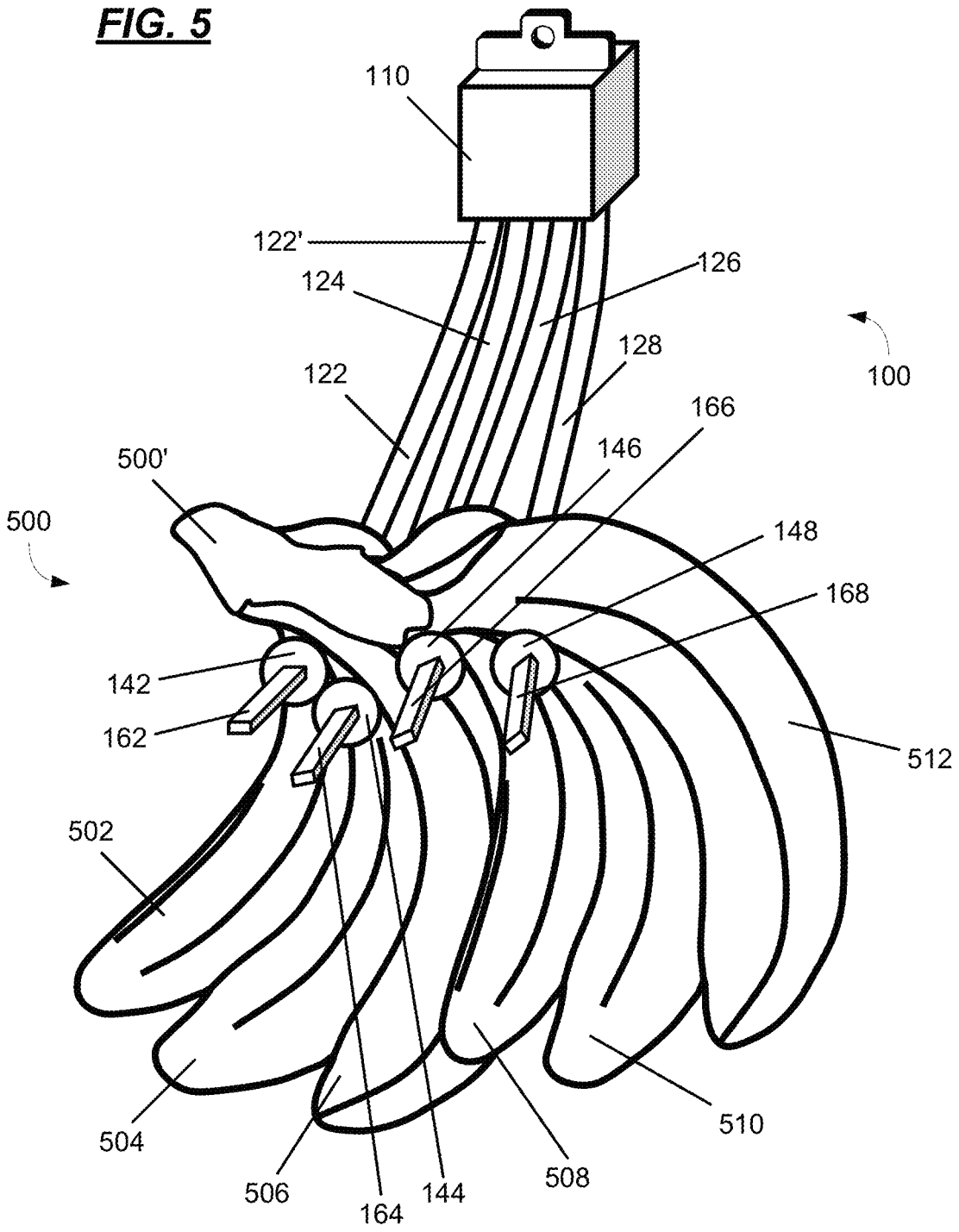
FIG. 5 is a three-dimensional perspective view of the exemplary dynamic non-piercing TSS of FIG. 1 further illustrating a single large hand of bananas suspended from four suspension strands representative of various implementations disclosed herein.

FIG. 5 is a three-dimensional perspective view of the exemplary dynamic non-piercing TSS 100 of FIG. 1 further illustrating a single large hand of bananas 500 suspended from four suspension strands 122, 124, 126, and 128 representative of various implementations disclosed herein. As illustrated in FIG. 5, all four suspension strands 122, 124, 126, and 128 are inserted in different gaps between adjacent fingers 502, 504, 506, 508, 510, 512 coupled to the single complex stem 500' of the hand 500. Thus, up to four of the six bananas are capable of being removed from the hand of bananas without repositioning at least one suspension strand (and corresponding suspension contact) which remains capable of suspending the hand of remaining bananas after said removal.

FIG. 6A is a three-dimensional perspective view illustrating a single suspension strand 122 of the exemplary dynamic non-piercing TSS 100 of FIG. 1 being utilized to suspend a single banana 600 (having a simple stem 600" and a complex stem 600') using a single tactile and manipulable twist of the lower end 122" of the single suspension strand 122 in a manner representative of various implementations disclosed herein. FIG. 6B is a three-dimensional perspective view illustrating a pair of suspension strands 122, 124 of the exemplary dynamic non-piercing TSS 100 of FIG. 1 being utilized to suspend a single banana 600 using a single overhand twist of the lower ends 122", 124" of the pair of suspension strands 122, 124 in a manner representative of various implementations disclosed herein. FIG. 6C is a three-dimensional perspective view of a single banana 650 (having a simple stem 650" but no complex stem) that may also be suspended from the single suspension strand 122 illustrated in FIG. 6A (by utilizing a single overhand knot), as well as from the pair of suspension strands 122, 124 illustrated in FIG. 6B (by utilizing the one of the two gaps created by the crossing of the two suspension strands 122, 124), both in a manner representative of various implementations disclosed herein.

As illustrated in FIGS. 6A-6C, and taking into account FIGS. 1-5, various implementations of the TSS 100 may feature an integration housing comprising at least one anchor engagement for use in suspending the anchor housing; one or more suspension strands, each suspension strand comprising a first end and a second end opposite the first end, the first end of each suspension strand coupled to the integration housing; and one or more suspension contacts, each suspension contact coupled to the second end of a suspension strand from among the one or more suspension strands, the suspension strand and coupled suspension contact being capable of (1) suspending a hand of bananas in a first use without piercing the hand of bananas and (2) suspending a single banana in a second use without piercing the single banana, even when the single banana comprises a simple stem but lacks a complex stem, by using, for example, a suspension strand that is knotable as described. Notably, each suspension strand with coupled suspension contact is capable of individually and simultaneously suspending a hand of bananas.

Figure 7:
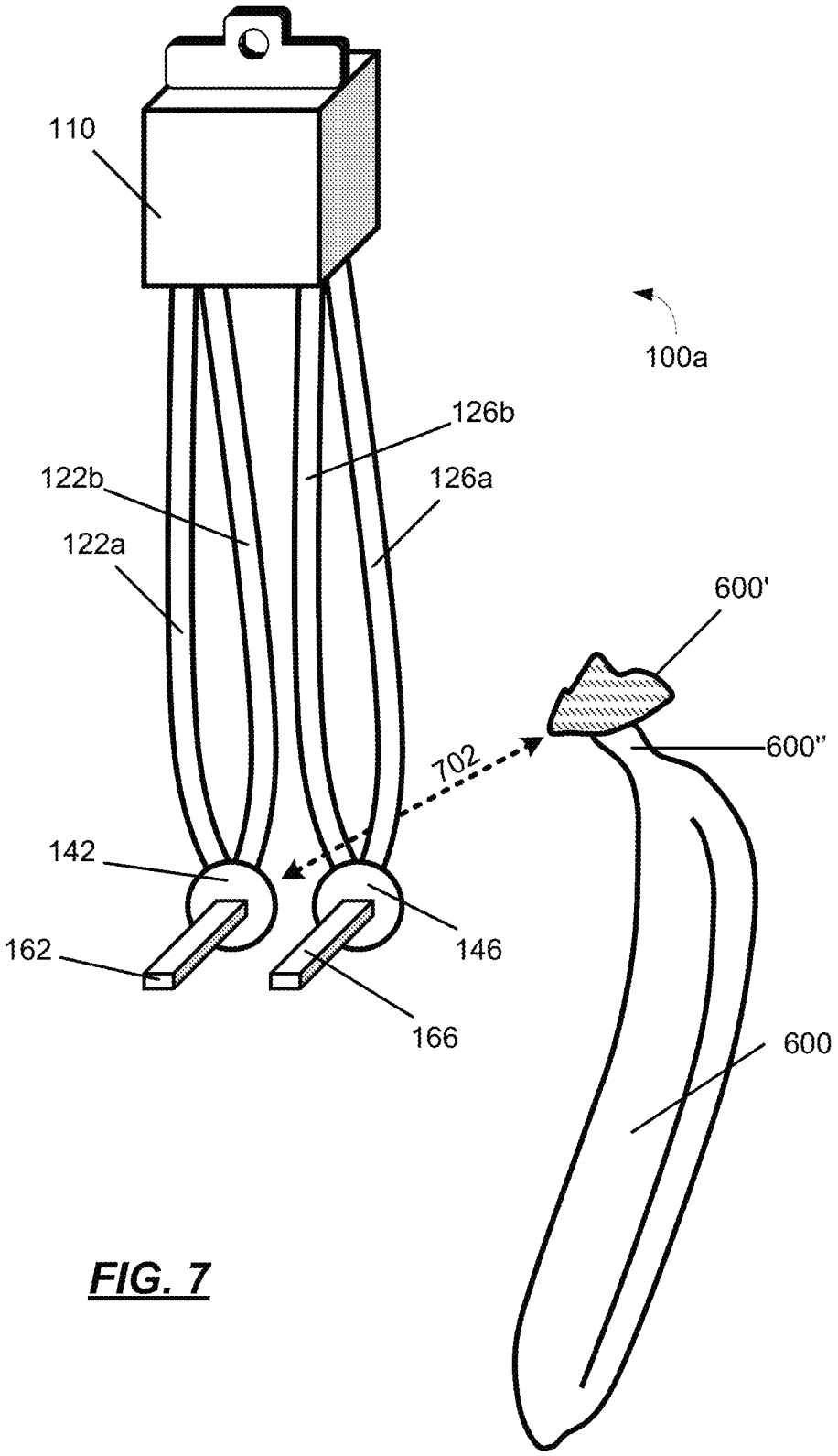
FIG. 7 is a three-dimensional perspective view illustrating single suspension strands each comprising two substrands for an exemplary dynamic non-piercing TSS capable of suspending a single banana using the convergence of the two substrands of a single suspension strand in a manner representative of various implementations disclosed herein.

FIG. 7 is a three-dimensional perspective view of a TSS 100*a* illustrating a single suspension strand 122 comprising two substrands 122*a*, 122*b*, and illustrating another single suspension strand 126 comprising two substrands 126*a*, 126*b*, each single suspension strand 122, 126 for an exemplary dynamic non-piercing TSS 100*a* capable of suspending a single banana 600 (having a simple stem 600" and a complex stem 600') using the convergence of the two substrands, respectively, 122*a*, 122*b* or 126*a*, 126 in a manner, such as 702, representative of various implementations disclosed herein. Various implementations of this system are also capable of suspending a single banana having a simple stem and a simple end but no complex stem (not shown).

Figures 8A, 8B, 8C:
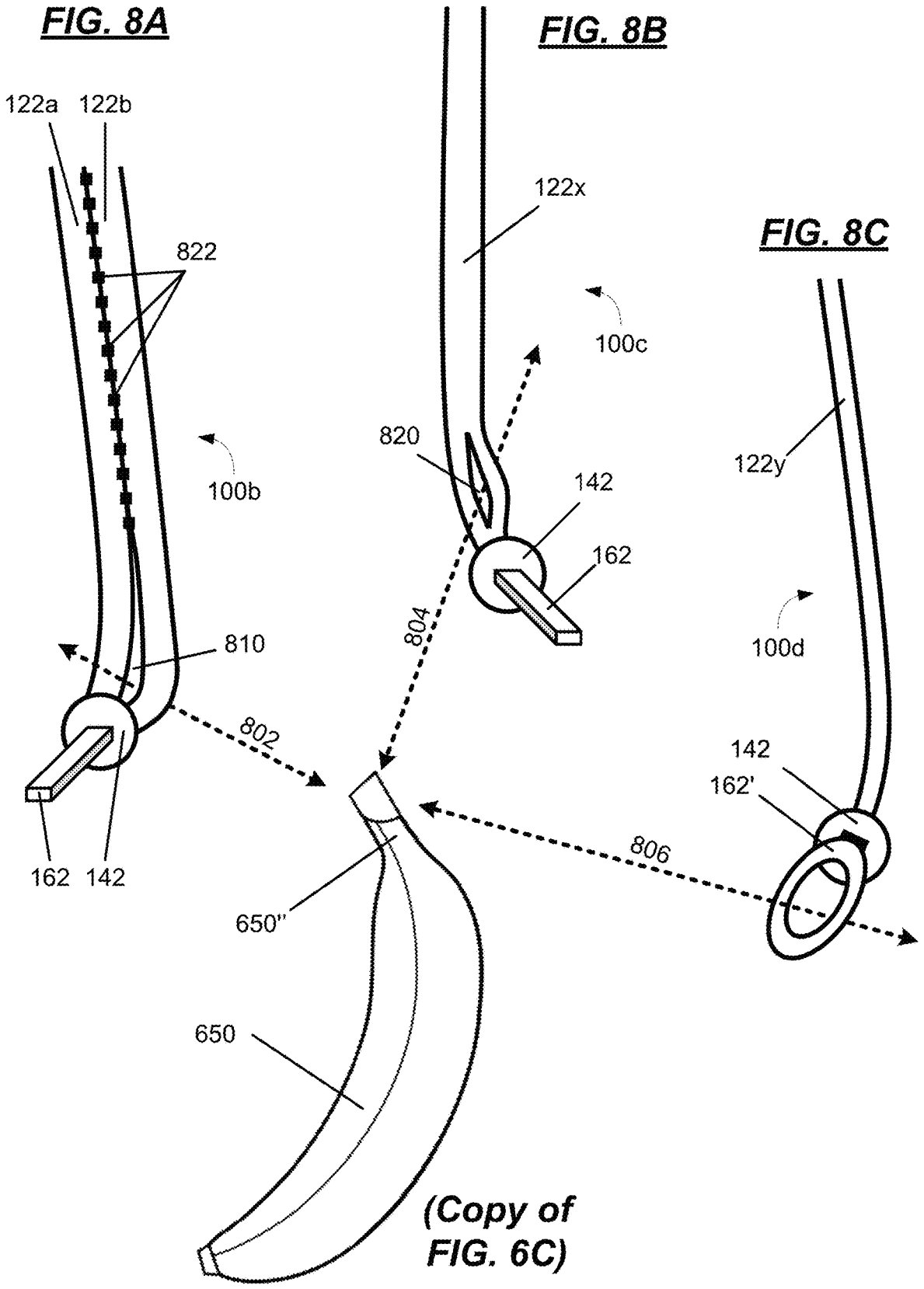
FIG. 8A is a three-dimensional perspective view illustrating a single suspension strand comprising two substrands substantially coupled but leaving an opening for use in suspending a single banana in a manner representative of several implementations disclosed herein.
FIG. 8B is a three-dimensional perspective view illustrating a single suspension strand comprising a button-hole opening for use in suspending a single banana in a manner representative of several implementations disclosed herein.
FIG. 8C is a three-dimensional perspective view illustrating a single suspension strand comprising a looped extension tab with an opening for use in suspending a single banana in a manner representative of several implementations disclosed herein.

FIG. 8A is a three-dimensional perspective view of a TSS 100*b* illustrating a single suspension strand 122 comprising two substrands 122*a*, 122*b* substantially coupled 822 but leaving an opening 810 for use in suspending 802 a single banana (such as banana 650 of FIG. 6C having a simple stem 650" but no complex stem) in a manner representative of several implementations disclosed herein. FIG. 8B is a three-dimensional perspective view of a TSS 100*c* illustrating a single suspension strand 122*x* comprising a buttonhole opening 820 for use in suspending 804 a single banana (such as banana 650 of FIG. 6C having a simple stem 650" but no complex stem) in a manner representative of several implementations disclosed herein. FIG. 8C is a three-dimensional perspective view of a TSS 100*d* illustrating a single suspension strand 122*y* comprising a looped extension tab 162' with an opening for use in suspending 806 a single banana (such as banana 650 of FIG. 6C having a simple stem 650" but no complex stem) in a manner representative of several implementations disclosed herein.

Regarding FIGS. 7 and 8A-8C: (1) for certain implementations at least one suspension strand from among the one or more suspension strands may comprise two substrands capable of suspending a single banana that comprises a complex stem as per FIG. 7; (2) for certain implementations at least one suspension strand may comprise an opening for suspending a single banana having a simple stem but lacking a complex stem; and/or (3) for certain implementations at least one extension tab may include an opening for suspending a single banana having a simple stem but lacking a complex stem.

FIG. 9 is a three-dimensional perspective view 900 of a first exemplary dynamic non-piercing TSS 100*x* operably coupled via neck 902 of extended hook 904 to a second exemplary dynamic non-piercing TSS 100*y* representative of certain implementations disclosed herein. Upper end 906 of neck 902 hangs from the integration housing of TSS 100*x* at 908, while lower end 904 of neck 902 hooks through the engagement feature of the anchor engagement of the integration housing of TSS 100*y*. As illustrated in FIG. 9, the use of more than one TSS can increase banana storage capacity in spaces having sufficient suspension clearance for multiple TSSs to be so coupled vertically in serial.

In view of the foregoing, various additional implementations disclosed herein may comprise: means for enabling said apparatus to be suspended from a suspension anchor point; and means for suspending a hand of bananas without piercing the hand of bananas, said means also capable of: suspending a single banana in a second use without piercing the single banana, engaging said hand of bananas at more than one engagement point, and engaging more than one hand of bananas simultaneously without piercing any of the more than one hand of bananas. For some such implementations, (1) the anchoring mechanism may comprise one from among the group comprising an under-edge mounting mechanism, a shelf mounting mechanism, an eye screw, an eye bolt, a wire rod, an S-mount, and a fixed hook; and/or (2) the anchor engagement may be integrated-by-manufacture into a first portion of the integration housing such that the anchor engagement is physically inseparable from, or in one piece with, the first portion of the integration housing.

In addition, various implementations disclosed herein are also directed to a method for suspending one or more bananas, the method comprising: for a hand of bananas, fitting at least one suspension strand, extending downward from a suspension point and terminating at a suspension contact, between a pair of adjacent fingers of a hand of bananas in sufficient proximity to a complex stem of the hand of bananas to prevent the suspension contact from slipping between the pair of adjacent fingers; and, for a single banana, manipulating at least one suspension strand in a stem-engaging configuration sufficient to engage the single banana proximate to the simple stem. For certain such implementations, the hand of bananas may be suspended using at least a first suspension strand while simultaneously the single banana is suspended using at least a second suspension strand that is not being utilized to suspend the hand of bananas. Select implementations may also include suspending the hand of bananas using at least two suspension strands each comprising flexible or elastic, or flexible and elastic, material or materials such that at least two suspension strands bear a portion of a total suspension weight corresponding to the hand of bananas.

FIG. 10 is a process flow diagram 1000 illustrating an exemplary method for utilization of a TSS (such as TSS 100 illustrated in FIG. 2) and an anchoring mechanism (such as any of the anchoring mechanisms 220, 240, 260, 280 illustrated in FIG. 2) to suspend a target item (such as banana 650 illustrated in FIG. 6C) representative of various implementations disclosed herein. As illustrated in FIG. 10, the process begins at 10 with affixing an anchoring mechanism in a desired location. At 20, the TSS is then coupled to the anchoring mechanism so that, at 30, a target item or target items (such as a hand of bananas, a single banana, or both) may be suspended by engaging at least one suspension strand to said target item. Alternatively, process elements 20 and 30 may be switched so that a target item or target items may be prepared for suspension by engaging at least one strand to said target item and then coupling the TSS to the anchoring mechanism (not shown).

Figure 11:
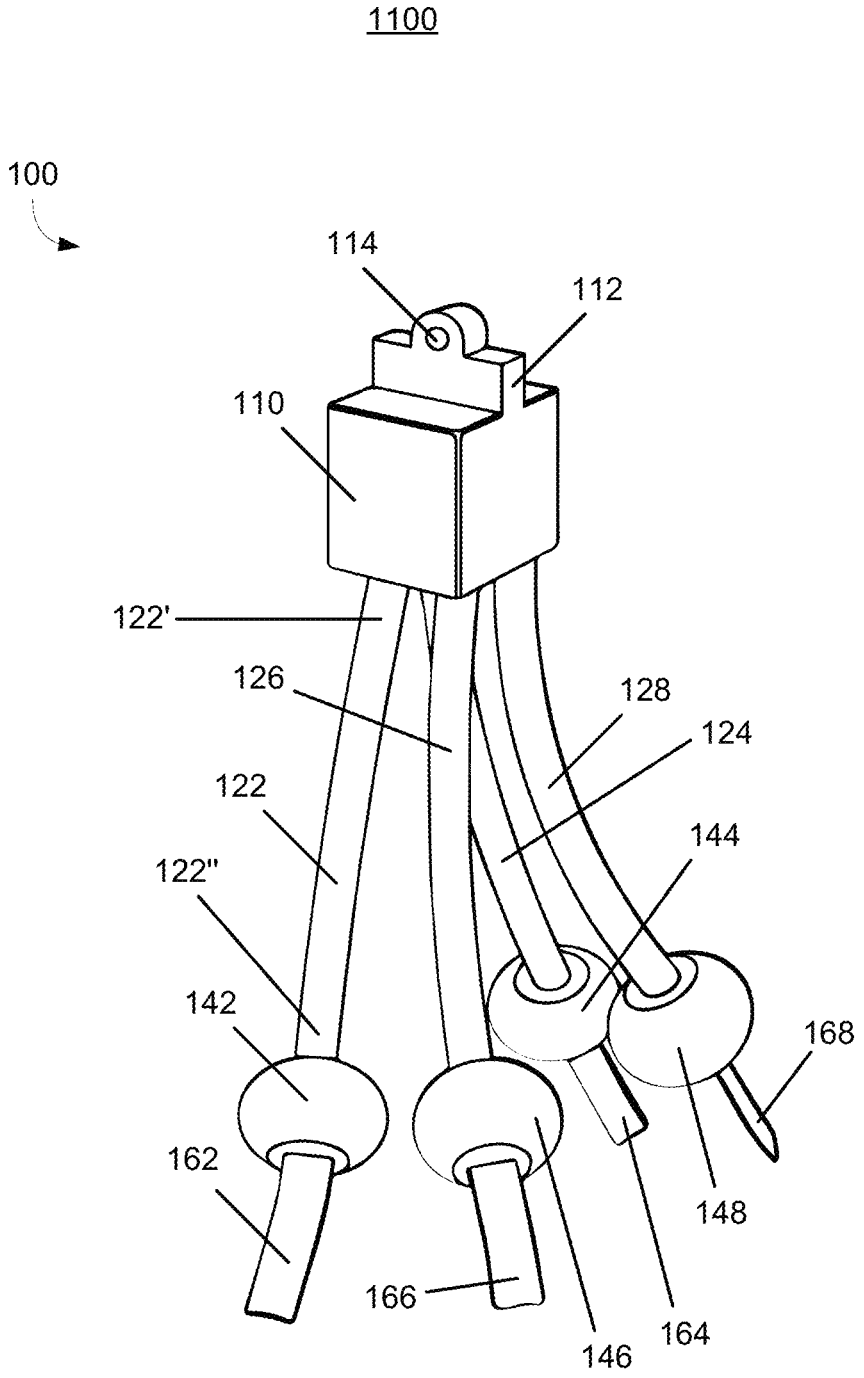
FIG. 11 is a detailed three-dimensional perspective view of an exemplary dynamic non-piercing TSS representative of specific implementations disclosed herein.

FIG. 11 is a detailed three-dimensional perspective view of an exemplary dynamic non-piercing TSS 1100 representative of specific implementations disclosed herein.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims. Moreover, the phrase "based on" does not mean "based only on," unless expressly specified otherwise. In other words, the phrase "based on" describes both "based only on" and "based at least on," or, if supported by the context, "based permissibly on."

Moreover, the flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure. As such, it should be noted that one or more of the features, functions, procedures, components, elements, structures, etc., described in connection with any one of the configurations, implementations, examples, or embodiments described herein may be combined with one or more of the functions, procedures, components, elements, structures, etc., described in connection with any of the other configurations, implementations, examples, or embodiments described herein, where compatible. In other words, any compatible combination of the functions, procedures, components, elements, etc., described herein may be implemented in accordance with the systems and methods disclosed herein.

Furthermore, unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one, whereas the term "subset" is used herein to indicate an integer quantity that is greater than or equal to one. Furthermore, in the above description reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular figure.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein. Furthermore, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims that follow.

What is claimed:

1. An apparatus comprising:

an integration housing comprising at least one anchor engagement for use in suspending the anchor housing;

one or more suspension strands, each suspension strand comprising a first end and a second end opposite the first end, the first end of each suspension strand coupled to the integration housing;

one or more suspension contacts, each suspension contact coupled to the second end of a suspension strand from among the one or more suspension strands, each suspension contact being substantially spherical, and each suspension strand and suspension contact being capable of:

suspending a hand of bananas in a first use without piercing the hand of bananas, and suspending a single banana in a second use without piercing the single banana; and one or more extension tabs, each extension tab coupled to a suspension contact from among the one or more suspension contacts variously coupled to the one or more suspension strands, each extension tab coupled opposite the second end of a corresponding one of the suspension strands coupled to the suspension contact.

2. The apparatus of claim 1, wherein the single banana comprises a simple stem but lacks a complex stem.

3. The apparatus of claim 1, wherein each suspension strand with coupled suspension contact is capable of simultaneously suspending a hand of bananas.

4. The apparatus of claim 1, wherein the suspended hand of bananas comprises at least three fingers, and wherein at least one finger from among the at least three fingers is capable of being removed from the hand of bananas without repositioning at least one of the suspension strands and corresponding suspension contact which remains capable of suspending the hand of bananas after said removal.

5. The apparatus of claim 1, wherein a hand of bananas is suspended by at least two of the suspension strands with coupled suspension contacts.

6. The apparatus of claim 5, wherein the at least two suspension strands bear a portion of a total suspension weight corresponding to the hand of bananas.

7. The apparatus of claim 1, wherein each suspension strand comprises a soft surface.

8. The apparatus of claim 1, wherein at least one of the suspension strands is knotable.

9. The apparatus of claim 1, wherein at least one suspension strand from among the one or more suspension strands comprises two substrands capable of suspending a single banana that comprises a complex stem.

10. The apparatus of claim 1, further comprising one or more pairs of suspension strands, each pair of suspension strands being formed from a single material strand, each single material strand comprising:

an intervening portion that passes in and is retained within the integration housing;

a first portion commencing from a first endpoint of the intervening portion, the first portion extending downward from and outside of the integration housing to form a first strand of the pair of strands; and a second portion commencing from a second endpoint of the intervening portion opposite the first endpoint, the second portion extending downward from and outside of the integration housing to form a second strand of the pair of strands.

11. The apparatus of claim 10, wherein the intervening portion is immovably fixed within the integration housing.

12. The apparatus of claim 1, wherein each of the one or more suspension strands is comprised of a flexible and elastic material.

13. The apparatus of claim 12, wherein at least one suspension strand from among the one or more suspension strands comprises an opening for suspending a single banana having a simple stem but lacking a complex stem.

14. The apparatus of claim 1, wherein the one or more extension tabs comprise flexible material.

15. The apparatus of claim 1, wherein each of the one or more extension tabs is thinner than the corresponding suspension contact to which each of said extension tabs is coupled.

16. The apparatus of claim 1, wherein the anchor engagement comprises an engagement feature for operably coupling to an anchoring mechanism in order to suspend the apparatus comprising the engagement housing and the one or more suspension strands, wherein the suspended apparatus is capable of suspending at least one target item.

17. The apparatus of claim 16, wherein the anchor engagement is integrated-by-manufacture into a first portion of the integration housing such that the anchor engagement is physically inseparable from the first portion of the integration housing.

18. An apparatus comprising:

an integration housing comprising at least one anchor engagement for use in suspending the anchor housing;

one or more suspension strands, each suspension strand comprising a first end and a second end opposite the first end, the first end of each suspension strand coupled to the integration housing;

one or more suspension contacts, each suspension contact coupled to the second end of a suspension strand from among the one or more suspension strands, each suspension strand and suspension contact being capable of:

suspending a hand of bananas in a first use without piercing or encompassing the hand of bananas, and suspending a single banana in a second use without piercing the single banana; and one or more extension tabs, each extension tab coupled to a suspension contact from among the one or more suspension contacts variously coupled to the one or more suspension strands, each extension tab coupled opposite the second end of a corresponding one of the suspension strands coupled to the suspension contact.

19. The apparatus of claim 18, wherein the single banana comprises a simple stem but lacks a complex stem.

20. The apparatus of claim 18, wherein each suspension strand with coupled suspension contact is capable of simultaneously suspending a hand of bananas.

21. The apparatus of claim 18, wherein the suspended hand of bananas comprises at least three fingers, and wherein at least one finger from among the at least three fingers is capable of being removed from the hand of bananas without repositioning at least one of the suspension strands and corresponding suspension contact which remains capable of suspending the hand of bananas after said removal.

22. The apparatus of claim 18, wherein a hand of bananas is suspended by at least two of the suspension strands with coupled suspension contacts.

23. The apparatus of claim 22, wherein the at least two suspension strands bear a portion of a total suspension weight corresponding to the hand of bananas.

* * * * *